United States Patent [19]

Wagner et al.

[11] 4,430,021

[45] Feb. 7, 1984

[54] SECURE CHEMICAL WASTE LANDFILL

[75] Inventors: Louis E. Wagner, Eggertsville; Randolph W. Rakoczynski, Youngstown, both of N.Y.; Harold F. Flannery, Batavia, Ohio

[73] Assignee: Ecological Professional Industries, Inc., Cincinnati, Ohio

[21] Appl. No.: 324,067

[22] Filed: Nov. 23, 1981

[51] Int. Cl.[3] ..... E02C 3/00

[52] U.S. Cl. ..... 405/129; 405/53; 405/270

[58] Field of Search ..... 405/270, 269, 268, 52, 405/53, 128, 129, 55; 210/170, 901

[56] References Cited

U.S. PATENT DOCUMENTS

| | | | |
|---|---|---|---|
| 2,333,287 | 11/1943 | Baird | 405/270 X |
| 3,383,863 | 5/1968 | Berry | 405/270 |
| 3,505,820 | 4/1970 | Draper et al. | 405/53 |
| 3,537,267 | 11/1970 | Webb | 405/53 |
| 3,736,754 | 6/1973 | Azalbert et al. | 405/53 |
| 4,030,307 | 6/1977 | Aredisian | 405/270 |
| 4,252,462 | 2/1981 | Klingle et al. | 210/170 X |
| 4,335,978 | 6/1982 | Mutch | 405/129 |
| 4,352,601 | 10/1982 | Yaliga et al. | 405/270 |

*Primary Examiner*—Dennis L. Taylor

*Attorney, Agent, or Firm*—Michael L. Dunn

[57] ABSTRACT

A chemical waste landfill comprising a plurality of compartments separated by and lined with a primary clay liner. A single integral synthetic water impervious liner is provided beneath the clay liners of all of the compartments and a primary underdrain system is provided for each compartment beneath the synthetic liner. A secondary clay liner is provided beneath the primary underdrain system and a secondary underdrain system is provided beneath the secondary clay liner. The invention also includes chemical waste landfills having in situ leachate treatment systems, increased security compartments having additional synthetic and clay liners and a leachate monitoring system comprising a plurality of standpipes interconnected by a liquid pervious means below the waste wherein the standpipes are protected by sleeves.

11 Claims, 2 Drawing Figures

SECURE CHEMICAL WASTE LANDFILL

BACKGROUND OF THE INVENTION (A) Field of the Invention

This invention relates to the disposal of chemical wastes and more particularly relates to secure chemical waste landfills.

(B) History of the Prior Art

In the prior art, disposal of chemical waste, and particularly hazardous chemical waste, posed a particularly difficult problem. Originally, there was little concern about the disposal of such chemical waste and they were simply discharged to bodies of water or were buried without concern for subsequent migration of the chemicals.

It later became apparent that care was required in disposing of such wastes. Chemical wastes were then frequently disposed of by placing them in a semi-secure landfill which was lined with water impermeable clay. Such landfills were still not considered adequate for particularly hazardous chemical wastes which were frequently disposed of by constructing concrete vaults in which the waste materials were deposited or by imbedding drums containing the materials in concrete.

Secure landfills were then designed which contained water impervious liners or films in addition to liners of clays or cement layers.

Even these landfills would occasionally leak thus creating leachates which contained chemical waste materials which could enter natural water supplies.

In addition, such landfills had another disadvantage since chemical waste within the landfill could frequently mix thus creating undesirable internal chemical reactions which cause fires, explosions or the creation of even more toxic materials than were originally introduced into the landfill.

Examples of such lined landfills are shown in U.S. Pat. Nos. 4,166,709; 3,732,697 and 3,586,624.

In order to overcome the problem of leachates, leachate collection systems were devised in order to collect leachates from the landfill and store or treat them so that the leachates could not enter natural water supplies. Examples of such leachate collection systems are described in U.S. Pat. Nos. 3,705,851 and 4,171,921. Such a system is also shown in an article in "Newsweek", Mar. 2, 1981 at page 67. In order to avoid mixing of chemicals within the landfill to cause more hazardous products, compartmented landfills were designed.

Even with all of the above described improvements in landfilling of chemical wastes, problems are still apparent. In particular, it has been found that a single leachate system may not be sufficient to collect all of the leachate which might leave the landfill, a single leachate collection still requires that hazardous wastes from all of the compartments in compartmented landfills will be mixed within the leachate collection system; all of the chemical materials collected in a leachate must continue to be treated; rupture of a single synthetic liner can permit increased leaching through the landfill; and chemical materials in adjacent compartments can leak through compartmental walls and still cause undesirable reactions.

Furthermore, in the prior art, monitoring wells were set up to the bottom of the landfill both to determine the composition and quantity of leachate and to permit removal of leachate for treatment. Such monitoring wells had permeable bases which unfortunately would frequently become clogged with sediment and, furthermore, all of the leachate did not necessarily migrate to the base of the well. In addition, such standpipes or wells could easily become damaged as materials were placed in the landfill.

BRIEF DESCRIPTION OF THE INVENTION

In accordance with the present invention, improvements are provided in chemical waste landfills which overcome the problems of prior art secure chemical landfills previously described. In particular, the chemical waste landfill of the present invention which overcomes the problem of leachate escaping through a leachate collection system and which almost completely overcomes the problem of the combining of leachates from multiple compartments and which adds further security to the integrity of the landfill is a landfill which comprises a plurality of compartments separated by and lined with a primary clay liner. The landfill has a single integral synthetic water impervious liner beneath the clay lining of all of the compartments and has a primary underdrain system for each of the compartments beneath the synthetic liner. Each of the primary underdrain systems comprises a network of liquid permeable first pipes imbedded in a first liquid permeable aggregate and means for removing liquid which enters the first pipes. The primary underdrain systems are separated from each other by clay footings.

The landfill further comprises a single integral secondary clay liner beneath the primary underdrain systems and footings of all of the compartments and has a secondary underdrain system beneath the secondary clay liner. The secondary underdrain system comprises a network of liquid permeable second pipes imbedded in a second liquid permeable aggregate and comprises means for removing liquid which enters the second pipes. The secondary underdrain system rests upon a base which is relatively impermeable when compared with the second liquid permeable aggregate.

Further, in accordance with the present invention, landfills are provided wherein less treatment of leachate is required due to an in situ leachate treatment system beneath a water impervious liner at the bottom of the landfill. And, includes a chemical waste landfill which has a leachate monitoring system which comprises a plurality of standpipes, each of which has a liquid pervious portion located at the position below the waste and above an impermeable liner and the top end located at a position above the waste. Each of the standpipes is provided with a protective sleeve having a liquid pervious portion located at a position below the waste and above the impermeable liner and further has a liquid pervious means below the waste and above the liner connecting the liquid pervious portion at each of the sleeves to the liquid pervious portion of at least one other sleeve.

DETAILED DESCRIPTION OF THE INVENTION

Figure 1:
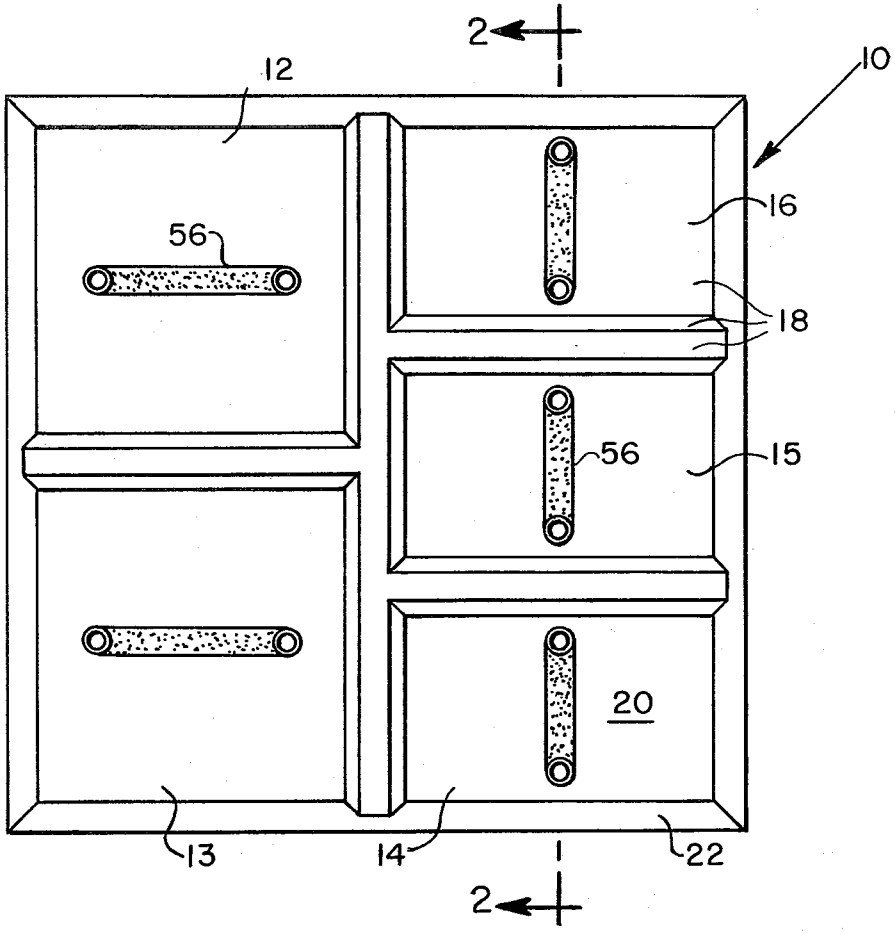
FIG. 1 is a top view of a landfill in accordance with a preferred embodiment of the invention and FIG. 2 is a cross sectional elevational view taken on line 2—2 of FIG. 1.

The chemical waste landfill in accordance with the present invention which overcomes the problem of leachate escaping the leachate collection system and which provides improvements in chemical waste landfill security, as previously discussed, comprises a plurality of compartments separated by and lined with a primary clay liner. The plurality of compartments are used to separate different types of chemical waste, for example, flammable materials, toxic materials, waste containing heavy metals and waste containing amphoteric metals. In accordance with the present invention, the compartments are arranged so that wastes, which would have a tendency to react with each other to form more hazardous materials, i.e., more toxic, flammable, explosive or migratory materials, are not in adjacent compartments.

The single integral synthetic water impervious liner beneath the clay lining of all of the compartments, i.e., a liner under essentially all of the landfill including upwardly sloped banks, is a liner manufactured of any suitable synthetic material. Such materials in general are flexible materials which do not crack or degrade under use conditions including the pressure, temperature and chemical exposure to which the liner is subjected. Many plastic films have been found suitable for this purpose including polyvinyl and polyolefin films. Particular examples of such liners are those manufactured of polyvinylchloride, polyethylene and polypropylene. "Do not degrade", as used herein, means that the film remains impervious to water for at least ten years and preferably for an extended periods of time including numerous decades and even centuries under use conditions.

As previously discussed, the landfill has a primary underdrain system for each of the compartments beneath the synthetic liner. Each of the primary underdrain systems comprises a network of liquid permeable first pipes imbedded in a first liquid permeable aggregate. The pipes are, in general, manufactured of a material of construction which is resistant to degradation under use conditions. Such pipes are usually manufactured of plastic materials such as polyethylene, polypropylene and polyvinylchloride. "Liquid permeable aggregate", as used herein, means any particulate material through which liquid will flow. Particular examples of such materials are sand, gravel, crushed stone and mixtures thereof. The means for removing liquid which enters the first pipes in the primary underdrain system usually includes a standpipe which is connected with the pipes beneath the synthetic liner and a pumping means for removing liquid through the standpipe. Alternatively, a pipe may be directly connected to the pipes beneath the synthetic liner (not technically a standpipe) which is directly connected with a pump means. The primary underdrain systems beneath each of the compartments are separated from each other by footings which are usually of impermeable clay. "Impermeable clay", as used herein, means clay which will pass water under a pressure of 165 pascals at a rate of less than $1\times10^{-7}$ centimeters per second.

A single integral secondary clay liner exists beneath the primary underdrain systems and footings of all of the compartments. Again, the secondary clay liner is of impermeable clay. The secondary clay liner usually has a thickness of from about 1 to about 4 meters and in a manner similar to the primary clay lining, slopes up the side walls of the chemical waste landfill.

The landfill is further provided with a secondary underdrain system beneath the secondary clay liner. The construction of the secondary underdrain system is similar to the construction of the primary underdrain system except that it comprises a network of liquid permeable second pipes imbedded in a second liquid permeable aggregate and extends beneath the entire landfill. The secondary underdrain system is provided with means for removing liquid which enters the second pipes. The secondary underdrain system rests upon a base which is relatively impermeable when compared with the second liquid permeable aggregate so that liquid which enters the secondary underdrain system either in the form of ground water or as leachate from the landfill can be removed before entering or re-entering the base.

Desirably, in accordance with the present invention, at least one of the compartments of the landfill is an increased security compartment for chemical wastes of a more hazardous nature. The increased security compartment further comprises an additional synthetic water impervious liner over the primary clay liner. The material of construction of the additional synthetic water impervious liner is selected to be chemical nonreactive with wastes stored in the increased security compartment. The additional liner is covered with a top clay liner having a thickness of from about 0.5 to about 1.0 meters. As is the case with the primary clay liner, the additional synthetic water impervious liner and top clay liner extend up the walls of the compartment.

The invention also includes a chemical waste landfill which comprises at least one compartment comprising a water impervious liner and an in situ leachate treatment system beneath the liner. Such an in situ leachate treatment system may be incorporated into landfills of the prior art or may be combined with the landfill of the invention previously described. The in situ leachate treatment system comprises a material which will react with at least some of the chemical components of leachate from waste in the compartment to prevent further migration of such components. In general, the material is a layer of particulate material beneath the synthetic liner. Such materials are usually selected from lime, limestone and carbon. Granular activated carbon has the ability to adsorb toxic, high molecular weight organic contaminants which are likely to be present in leachates generated in compartments which contain organic materials such as organic flammable materials and organic toxic materials. Carbon can also be used to adsorb residual, trace levels of various metallic ions and can therefore be used beneath compartments which contain such metallic materials. Lime can be used beneath compartments containing heavy metals since lime will precipitate such metallic contaminants which then become trapped in the lime. Crushed limestone can be used beneath materials containing amphoteric metals which limits the mobility of such materials.

Desirably, when the landfill comprises an increased security compartment as previously described, such an in situ leachate treatment system is incorporated beneath the additional synthetic water impervious liner. The in situ leachate treatment system beneath the additional synthetic water impervious liner may be in addition to a further in situ leachate treatment system beneath the single integral synthetic water impervious liner which is beneath the clay lining of all of the compartments. When more than one in situ leachate treatment system is located beneath the single integral water impervious liner, such treatment systems are usually separated by water impermeable clay.

In accordance with the present invention, a chemical waste landfill leachate monitoring system is provided which may be used in conjunction with the landfills previously described or in landfills of the prior art. The chemical waste landfill leachate monitoring system in accordance with the invention comprises a plurality of standpipes, each of which has a liquid pervious portion located at the position below the waste and above an impermeable liner and a top end located at a position above the waste. The monitoring system further includes a protective sleeve for each standpipe. The protective sleeve also has a liquid pervious portion located at a position below the waste and above the impermeable liner. The monitoring system also includes a liquid pervious means below the waste and above the liner connecting the liquid pervious portion of each of the sleeves to the liquid pervious portion of at least one other sleeve. The liquid pervious means may be a pervious pipe but is usually a water permeable aggregate as previously described.

In operation, leachate from the landfill, or compartment within the landfill, collects above the impermeable liner within the liquid pervious means which conducts the leachate to the liquid pervious portion of the protective sleeve. Leachate then passes through the liquid pervious portion of the protective sleeve to the liquid pervious portion of the standpipe. The leachate can then be monitored or removed through the standpipe. The protective sleeve serves a dual purpose since it reduces the likelihood that the bottom of the standpipe will become clogged with sediment and it protects the standpipe from damage when waste are being placed in the landfill. The plurality of intercommunicating standpipes assures that at least one standpipe will be operative at any given time to monitor or remove leachate from above the impermeable liner. When the monitoring system is used in conjunction with a multiple compartmented landfill, multiple monitoring systems are used, i.e., at least one such leachate monitoring system for each compartment.

Figure 2:
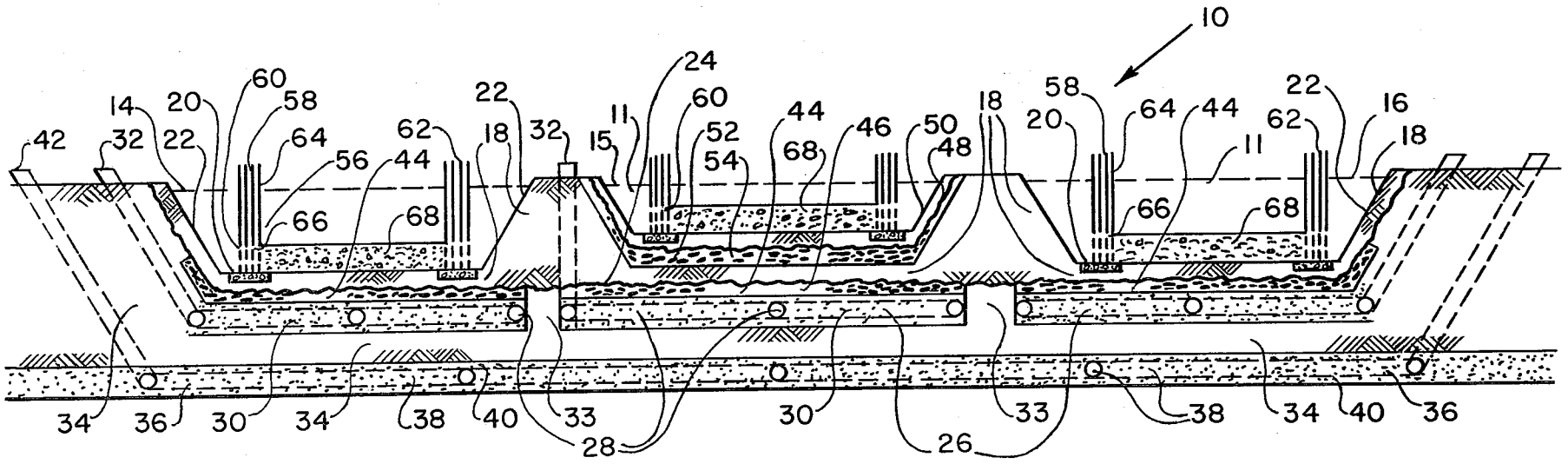

Referring now to the drawings, as best seen in FIGS. 1 and 2, a landfill 10 in accordance with a preferred embodiment of the invention comprises a plurality of compartments 12 through 16 separated by and lined with a primary clay liner 18 which, except for increased security compartment 15, form the bottom 20 and side walls 22 of the compartments. An integral synthetic water impervious liner 24, as best seen in FIG. 2, is provided beneath the primary clay liners of all of the compartments.

A primary underdrain system 26 for each of the compartments is provided beneath synthetic liner 24. Each of the primary underdrain systems 26 comprises a network of liquid permeable first pipes 28 imbedded in a first liquid permeable aggregate 30. A means for removing liquid which enters first pipes 28 is provided which usually comprises an access pipe 32 connected to a pump which is not shown. Primary underdrain systems 26 are separated from each other by clay footings 33.

A single integral secondary clay liner 34 is provided beneath primary underdrain systems 26 and footings 33. Footings 33 and secondary clay liner 34 are usually integral with each other.

A secondary underdrain system 36 is provided beneath secondary clay liner 34. Secondary underdrain system 36 comprises a network of liquid permeable second pipes 38 imbedded in a second liquid permeable aggregate 40. Means is provided for removing liquid which enters second pipes 38 which usually comprises an access pipe 42 connected to a secondary underdrain system pump which is not shown.

Each of the compartments is provided with an in situ leachate treatment system 44 beneath synthetic water impervious liner 24. The in situ leachate treatment system 44 comprises a material 46 which will react with at least some of the chemical components of leachate from waste to be stored in the compartment of the landfill to prevent further migration of such chemical components.

At least one of the compartments 15 is an increased security compartment which further comprises an additional synthetic water impervious liner 48 which is selected to be chemically non-reactive with wastes stored in compartment 15. Additional liner 48 is covered with a top clay liner 50. Increased security compartment 15 is further provided with an additional in situ leachate treatment system 52 beneath additional synthetic liner 48. In situ leachate treatment system 52 also comprises a material 54 which will react with at least some of the chemical components of leachate from waste stored in compartment 15 to prevent further migration of such components.

Each of the compartments 12 through 16 includes a chemical waste landfill leachate monitoring system 56. Leachate monitoring system 56 comprises a plurality of standpipes 58, each of which has a liquid pervious portion 60 located at the position below the waste and above impermeable liner 24 and a top end 62 located at a position above the waste. A protective sleeve 64 is provided for each standpipe having a liquid pervious portion 66 located at a position below the waste and above impermeable liner 24. A liquid pervious means, in the form of mixed sand and gravel 68, is provided which is below the waste and above liner 24. Liquid pervious means 68 connects the liquid pervious portions 66 of sleeve 64 to the liquid pervious portion of at least one other sleeve 64.

In operation, waste 11 stored within compartments 12 through 16 of landfill 10 are retained by primary clay liner 22 except for increased security compartment 15 wherein wastes are retained by additional clay liner 50. Any leachate which forms in compartments 12 through 16 are collected by liquid pervious means 68 and conducted to protective sleeves 64 and standpipes 58. The plurality of standpipes increases the probability that at least one standpipe 58 will be operative at all times and provides for leachate monitoring over essentially the entire bottom of the compartments. Sleeves 64 protect standpipes 58 from damage during the time that wastes are introduced into the landfill. Primary clay liner 22, integral synthetic water impervious liner 24, secondary clay liner 34, top clay liner 50 and additional synthetic liner 48 all contribute to the integrity of the landfill assuring that there is no leakage. Primary underdrain system 26 assures that the majority of leachate from wastes stored in the compartments is collected and treated and secondary underdrain system 36 prevents ground water from entering the compartments and collects any leachate which might escape collection by the leachate monitoring system or primary underdrain system. In situ leachate treatment systems 44 and 52 chemically treat leachate even before it is collected by primary underdrain systems 26.

What is claimed is:

1. A chemical waste landfill comprising:

(a) a plurality of compartments separated by and lined with a primary clay liner;

(b) a single integral synthetic water impervious liner beneath the primary clay lining of all of said compartments;

(c) a primary underdrain system for each of said compartments beneath said synthetic liner, each of said primary underdrain systems comprising a network of liquid permeable first pipes imbedded in a first liquid permeable aggregate and means for removing liquid which enters said first pipes, said primary underdrain systems being separated from each other by clay footings;

(d) a single integral secondary clay liner beneath the primary underdrain systems and footings of all of said compartments; and (e) a secondary underdrain system beneath said secondary clay liner, said secondary underdrain system comprising a network of liquid permeable second pipes imbedded in a second liquid permeable aggregate; and means for removing liquid which enters said second pipes.

2. The chemical waste landfill of claim 1 wherein the secondary underdrain system rests on a base which is relatively impermeable when compared with said second liquid permeable aggregate.

3. The landfill of claim 1 wherein at least one of said compartments comprises an in situ leachate treatment system beneath said synthetic water impervious liner.

4. The landfill of claim 3 wherein said in situ leachate treatment system comprises a material which will react with at least some of the chemical components of leachate from waste in the compartment to prevent further migration of such components.

5. The landfill of claim 4 wherein said material of the in situ leachate treatment system is selected from the group consisting of lime, limestone and carbon.

6. The landfill of claim 3 wherein a plurality of said compartments comprise an in situ leachate treatment system beneath said synthetic water impervious liner.

7. The landfill of claim 1 wherein at least one of said compartments, as an increased security, further comprises an additional synthetic water impervious liner over said primary clay liner, the material of construction of said additional synthetic water impervious liner being selected to be chemically non-reactive with wastes stored in said compartment and said additional liner being covered with a top clay liner.

8. The landfill of claim 7 wherein the increased security compartment further comprises an in situ leachate treatment system beneath the additional synthetic liner; said in situ leachate treatment system comprising a material which will react with at least some of the chemical components of leachate from waste stored in the increased security compartment to prevent further migration of such components.

9. The chemical waste landfill of claim 1 wherein each of said compartments includes a chemical waste landfill leachate monitoring system, said system comprising:

(a) a plurality of standpipes, each of which has a liquid pervious portion located at a position below the waste and above an impermeable liner at the bottom of the landfill and a top end located at a position above the wastes;

(b) a protective sleeve for each standpipe having a liquid pervious portion located at a position below the waste and above said impermeable liner; and (c) a liquid pervious means below said waste and above said liner connecting the liquid pervious portion of each of the sleeves to the liquid pervious portion of at least one other sleeve.

10. The chemical waste landfill of claim 1 wherein each of said compartments is used to store a different class of chemical wastes, said compartments being arranged so that wastes stored in adjacent compartments will not react to form materials more hazardous than the original stored wastes.

11. A chemical waste landfill leachate monitoring system which comprises:

(a) a plurality of standpipes, each of which has a liquid pervious portion located at a position below the waste and above an impermeable liner and a top end located at a position above the wastes;

(b) a protective sleeve for each standpipe having a liquid pervious portion located at a position below the waste and above said impermeable liner; and (c) a liquid pervious means below said waste and above said liner connecting the liquid pervious portion of each of the sleeves to the liquid pervious portion of at least one other sleeve.

* * * * *